US006935547B2

(12) United States Patent
Mochizuki

(10) Patent No.: US 6,935,547 B2
(45) Date of Patent: Aug. 30, 2005

(54) STAPLER APPARATUS

(75) Inventor: Naoto Mochizuki, Yamanashi Prefecture (JP)

(73) Assignees: ACCO Brands, Inc., Lincolnshire, IL (US); NISCA Corporation, Yamanashi-Ken (JP)

( * ) Notice: Subject to any disclaimer, the term of this patent is extended or adjusted under 35 U.S.C. 154(b) by 0 days.

(21) Appl. No.: 10/477,327

(22) PCT Filed: May 30, 2002

(86) PCT No.: PCT/IB02/01933

§ 371 (c)(1),
(2), (4) Date: Nov. 11, 2003

(87) PCT Pub. No.: WO03/008161

PCT Pub. Date: Jan. 30, 2003

(65) Prior Publication Data

US 2004/0169058 A1 Sep. 2, 2004

(30) Foreign Application Priority Data

May 31, 2001 (JP) ..... 2001-165884

(51) Int. Cl.[7] ..... B25C 5/15

(52) U.S. Cl. ..... 227/131; 227/119; 227/129; 227/155

(58) Field of Search ..... 227/4, 82, 119, 227/120, 129, 131, 155; 74/53, 55, 567, 569, 56

(56) References Cited

U.S. PATENT DOCUMENTS 4,046,027 A * 9/1977 Rudszinat ..... 74/567
4,611,536 A * 9/1986 Moriya ..... 101/93.21
4,726,505 A * 2/1988 Okazaki ..... 227/132
4,844,319 A * 7/1989 Kurosawa ..... 227/79
5,009,355 A 4/1991 Akizawa et al.
5,195,671 A 3/1993 Shimomura et al.
5,222,645 A * 6/1993 Sueda ..... 227/7
5,269,451 A * 12/1993 Udagawa et al. ..... 227/120
5,413,266 A 5/1995 Jairam
6,021,573 A * 2/2000 Kikuchi et al. ..... 30/392
6,036,074 A 3/2000 Manabe
6,068,173 A * 5/2000 Sueda ..... 227/7
6,135,337 A 10/2000 Harris et al.
6,164,513 A 12/2000 Yoshie

* cited by examiner

*Primary Examiner*—Louis K. Huynh
*Assistant Examiner*—Chukwurah Nathaniel

(74) *Attorney, Agent, or Firm*—Michael Best & Friedrich LLP

(57) ABSTRACT

A stapler apparatus includes a staple driving member to drive staples into a sheet bundle and being reciprocally supported on a frame. The staple driving member is configured to engage and drive staples. A cam member is interlocked to the staple driving member to reciprocally move the staple driving member. A drive motor is interlocked to the cam member. The cam member includes at least two rotating cams comprising rotating shafts extending in a direction intersecting a plane formed by said staple driving member reciprocal movement locus. The two rotating cams and the staple driving member abut at at least two points.

12 Claims, 11 Drawing Sheets

21 = Drive motor

22 = Deceleration gears

23 = First cam member

24 = Second cam member 23e, 24e = Rotating cams 23g, 24g = Driver swinging pins

60 = Driver

STAPLER APPARATUS

DETAILED DESCRIPTION OF THE INVENTION

1. Field of Application

The present invention relates to a stapler apparatus for stapling a bundle of predetermined sheets put thereon with motor-driven staple driving means.

2. Prior Art

A previous stapler apparatus for automatically stapling a sheet bundle with special staples is structured so that a band-like staple member is bent into U-shape, a staple driving member for driving staples into the sheet bundle is mounted to freely move up and down on an apparatus frame, and the staple driving member is moved up and down by a rotating cam interlocked to a drive unit. In a general stapling operation, the staple driving member bends a linear staple to U-shape by reciprocal movement of a plate-shaped driver, then drives the staple into the sheet bundle and at the same time, clinches an end of the staple driven through the sheet bundle with a clinching member disposed on an opposite side of the sheet bundle.

The staple driving member, when interlocking the rotating cam interlocked with a drive motor, has a right and left paired rotating cams disposed on an apparatus frame and interlocks to the staple driving member a swinging arm driven by the paired cams. That is, the apparatus frame having the staple driving member has the right and left paired rotating cams having rotating shafts in parallel with a plain on which the staple driving member moves reciprocally, the paired winging arms ends of which are supported on the frame are fitted with cam faces of the cams, and the staple driving member is interlocked to ends of the paired swinging arms to move up and down reciprocally.

PROBLEMS TO BE SOLVED BY THE INVENTION

The previous stapler apparatus is structured so that the apparatus frame shaped like horseshoe in cross section has the staple driving member arranged at a center, and the apparatus frame has the paired rotating cams and swinging arms arranged to project at a right and left ends. Such a structure is disadvantageous in that the rotating cams and swinging arms that are driving members are protruded out of the apparatus frame. This involves problems such as the apparatus becomes large in size, generates large noise, and is not safe. To solve the problems, the inventor obtained such knowledge that the apparatus frame should have the staple driving member, the rotating cams, and their driving members arranged at a center thereof and that the rotating cams and the staple driving member should be directly interlocked together without arm members, thereby simplifying the structure. On the basis of the knowledge, it was tried to arrange rotating shafts of the rotating cams in a direction to intersect or orthogonal a plane formed by a reciprocal movement locus of the staple driving member. However, he found that such a parallel arrangement of the plate-like staple driving member and the cam faces of the rotating cams to directly fit the staple driving member and the cam faces together with pins or the like, displaces fitting portions thereof in a width direction of the staple driving member. This affects staple driving operation undesirably. That is, with interlocking of the plate-like member with the rotating cams using an eccentric pin, fitting of the plate-like staple driving member with the eccentric pin is at one point, so that the contact point may move in the width direction with rotation of the cams. As described above, it is a problem that when force transmission of the rotating cams to the staple driving member moves through different points, force deviates, resulting in abnormal staple driving operation.

In view of solving the foregoing problems of the previous arts, it is an object of the present invention to provide a stapler apparatus that can perform secure stapling operation and make the overall apparatus smaller in size and more stable in operation.

MEANS TO SOLVE THE PROBLEMS

To solve the problems mentioned above, the stapler apparatus of the present invention comprises a stapler driving member supported reciprocally movable on a frame for driving staples into a sheet bundle, cam members linked to the staple driving members to move reciprocally the staple driving members, and a drive motor linked to the cam members, wherein the cam members are made up of at least two rotating cams having rotating shafts intersecting a plane formed of a reciprocal movement locus of the staple driving member, and the two rotating cams and the staple driving member are engaged at at least two points.

In one embodiment, the invention comprises a plate-like stapler driving member supported reciprocally movably between right and left paired side frames for driving staples into the sheet bundle, cam members supported between the paired side frames and linked to the staple driving members to move reciprocally the staple driving members, and a drive motor mounted between the paired side frames and linked to the cam members, wherein the cam members are made up of at least two rotating cams having rotating shafts intersecting a plane formed of a reciprocal movement locus of the staple driving member, and the two rotating cams and the staple driving member are engaged at at least two points.

In one aspect of the invention, the two rotating cams can uniformly transmit force to the staple driving member to move it reciprocally, thus not shaking the staple driving member right and left in pushing the staples. The staple driving member also can be moved reciprocally while being supported at the two points so that rotational torque of the drive motor can be transmitted effectively, thus increasing stability of the reciprocal movement.

In a further aspect, the invention is characterized in that rotating shafts of the rotating cams are arranged to virtually cross the plane formed of the reciprocal movement locus of the staple driving member.

According to the present invention, the rotating shafts of the rotating cams are arranged to virtually cross or orthogonalize the plane formed of the reciprocal movement locus of the staple driving member so that the rotational torque of the drive motor can be converted to reciprocal movement of the staple driving member at a high efficiency.

In yet another aspect of the invention, the rotating cams have cam faces displaced in a direction of reciprocal movement of the staple driving member as the rotating cams rotate.

According to the present invention, the rotating cams have the cam faces for swinging movement so that interlocking of the staple driving member can be easily made to directly displace the staple driving member in direction of reciprocal movement. This provides high drive transmission efficiency and smooth operation.

In another aspect of the invention, the at least two rotating cams are linked to the drive motor so that the rotating cams rotate in different directions.

According to the invention, the two rotating cams are driven in different rotational directions, inward or outward, so that pressure to the staple driving member put between the both rotating cams can be balanced on a right and left ends. This allows the staple driving member to reciprocally move in virtually linear locus, without deviating right and left.

In a further aspect of the invention, the staple driving member is engaged with at least the two rotating cams to transmit forward and backward movements to the staple driving member.

According to the invention, forward movement and backward movement of the staple driving member can be made by the paired rotating cams, thereby eliminating the different cam members as in the previous forward movement cam and backward movement cam and allowing easy synchronization.

In one embodiment, the staple driving member and the rotating cams have pin members formed on either one and slit grooves formed on the other one. The respective pin members and slit grooves are fitted together to engage.

According to the invention, the pin members disposed on the rotating cams should be just fitted with the slit grooves formed on the staple driving member so that direct interlocking can be made without other members, allowing easy assembling. As no other members are provided between the rotating cams and the staple driving member, rotation movement of the rotating cams can be smoothly and efficiently converted and transmitted to reciprocal movement of the staple driving member, and synchronization can be easily made.

Embodiments

The following describes an embodiment of the stapler apparatus of the present invention by reference to the accompanying drawings. FIG. 1 is a perspective view of an overall structure of a stapler apparatus of the present invention. FIG. 2 is a side view of the stapler apparatus shown in FIG. 1. FIG. 3 is a perspective view of main units of the stapler apparatus, including a driver unit and an anvil unit. FIG. 4 is a perspective view of main parts of the driver unit. FIG. 5 is a perspective exploded view of the driver unit. FIG. 6 is a plan view of a driver of the driver unit.

The stapler apparatus 10 in the embodiment, as shown in FIGS. 1 and 2, has a U-shaped apparatus frame 11 formed of a right and left paired side frames 11*a* and 11*b* and a bottom plate 11*c* as a profile therefore, a driver unit 20 built in the apparatus frame 11 as a staple driving member, an anvil unit 30 supported rotatably on the apparatus frame 11 as a bending member, and a staple supply unit 40 arranged detachably at a rear of the apparatus frame 11. The driver unit 20 is structured so as to separate staples one by one from the sheet-like staple band having many staples interlocked together like a band, to form the separated staples to a U-shape, and to drive in thickness direction the staples into the sheet bundle fed in the anvil unit 30 positioned above. The anvil unit 30 arranged against the driver unit 20, on the other hand, is structured so as to receive both ends of the staple driven in the sheet bundle before to bend the both ends inward, thereby finally stapling the sheet bundle.

The apparatus frame 11 has a mount 12 disposed for mounting a staple supply unit 40 at the rear thereof and has a sheet table 13 for bundling sheets at a front thereof. The apparatus frame 11 also has a driver unit 20 for driving sheet-like staples fed from the staple supply unit 40 therein and has a drive motor for driving the driver unit 20 therein. The staple supply unit 40 has a cassette 41 containing the staples interlocked together like a sheet and has a holder 42 for containing the cassette 41, being detachably mounted on a mount 12 of the apparatus frame 11. The driver unit 20 is described below in detail by reference to FIGS. 3 through 5. The driver unit 20 comprises a drive motor 21, deceleration gears 22, a first cam member 23, a second cam member 24, and a driver 60. The deceleration gears 22, the first cam member 23 and the second cam member 24 are assembled in a housing 25 having a partition wall therein and are swingably supported by an outside wall and the partition wall. The drive motor 21 is made up of a single dc motor an output gear 21*a* of which has the deceleration gears 22 interlocked thereto. The deceleration gears 22 comprise a first deceleration gear 22*a*, a second deceleration gear 22*b*, a third deceleration gear 22*c*, a fourth deceleration gear 22*d*, a fifth deceleration gear 22*e*, a sixth deceleration gear 22*f*, and a seventh deceleration gear 22*g* as looking toward outside from the output gear 21*a*. The sixth deceleration gear 22*f* is a final gear stage to swing the first cam member 23. The seventh deceleration gear 22*g* is a final gear stage to swing the second cam member 24.

Both the first cam member 23 and the second cam member 24 are formed of the same member and arranged in parallel with the drive motor 21. The first cam member 23 and the second cam member 24 are made up of drive gears 23*a* and 24*a* that have the torque to rotate in different directions by the sixth deceleration gear 22*f* and the seventh deceleration gear 22*g*, eccentric cams 23*c* and 24*c* that are fitted via shafts 23*b* and 24*b*, and rotating cams 23*e* and 24*e* for reciprocally moving the driver 60, respectively. The eccentric cams 23*c* and 24*c* are shaped virtually semicircle, peripheries of which drives the anvil unit 30 to swing. The eccentric cams 23*c* and 24*c* also have clincher swinging shafts 23*d* and 24*d* projected thereout for swinging a clincher unit disposed inside the anvil unit 30, respectively. The rotating cams 23*e* and 24*e*, on the other hand, are rotatably supported by the eccentric cams 23*c* and 24*c* and engaging pins 23*f* and 24*f* and are rotated in synchronization with the drive gears 23*a* and 24*a*. The rotating cams 23*e* and 24*e* have driver swinging pins 23*g* and 24*g* arranged symmetrically in a standing condition at positions separated from centers thereof on front surfaces thereof, respectively. The driver swinging pins 23*g* and 24*g* are engaged with slits 62*a* and 62*b* opened on a driver body 61, respectively. As described above, the first cam member 23 and the second cam member 24 operate the anvil unit 30, the clincher unit 50, and the driver 60 at the same time.

The driver 60, as shown in FIGS. 4 through 6, is made up of the driver body 61 having a paired horizontally long right and left slits 62*a* and 62*b* of identical shape formed thereon and of a vertically long driver head 63 disposed orthogonally with the driver body 61. The driver head 63 is formed of plate material thickness of which is virtually same as the staple at a leading edge 64 thereof. The driver head 63 has a long hole 65 for engaging a staple forming member 77 (which will be described later) in a longitudinal direction at a central portion thereof and has guide plate springs 66*a* and 66*b* disposed for engaging with the staple forming member 77 to press in while driving the staple.

The driver 60 formed as described above moves the driver head 63 one reciprocal stroke while the driver swinging pins 23*g* and 24*g* fitted with the respective slits 62*a* and 62*b* of the driver body 61 rotate one turn. This completes stapling operation. The driver swinging pints 23*g* and 24*g* are symmetrically set not to deviate an acting point for the driver 60. The rotating cams 23*c* and 24*e* having the driver swinging pins 23*g* and 24*g* can rotate in three ways as shown in FIG. 7: (a) inward rotations in different directions, (b)

outward rotations in different directions, and (c) identical rotations in same directions. In any of the rotational ways, single rotations of the rotating cams will reciprocate the driver head 63 up and down. The rotations a and b above are just different in rotational direction for balancing the acting points to the driver 60. The forces applied to a movement center of the driver head 63 can be always balanced at a right and left ends. The rotations c, on the other hand, provide a certain force rightward or leftward, causing a little shaking in the driver head 63 as compared with the rotations a and b. However the two driver swinging pins 23*g* and 24*g* provided on the two respective rotating cams 23*c* and 24*e* are used for swinging, providing far more stable operation than the previous single cam drive. The rotational directions should be selected depending on forms of the drive motor 21 and the cam members 23 and 24. As described above, the driver 60 features that the rotations of the rotating cams 23*e* and 24*e* arranged symmetrically make upward or downward pushing while moving the acting points in sequence, not causing the driver head 63 to shake right or left. This allows the staples to pass securely through even a large amount of sheet bundle.

The anvil unit 30, as shown in FIG. 3, is made up of an anvil 31 for pressing the sheet bundle and paired anvil arms 32*a* and 32*b* extended from respective ends of the anvil 31 for pinching both sides of the apparatus frame 11. The anvil 31 has a flat sheet pressing surface 33 and a clincher covered with a cover 34 on the sheet pressing surface 33. The anvil arms 32*a* and 32*b* are made swingable with centers of first swinging fulcrums 35*a* and 35*b* supported axially at the apparatus frame 11. It should be noted that the anvil arms 32*a* and 32*b* and the apparatus frame 11 are urged at their respective lower ends by the first spring 36*a* and 36*b* as shown in FIGS. 1 and 2 so that the anvil 31 can be placed at a position opened for the sheet table 13 to put the sheet bundle therein in normal state.

The anvil unit 30, as shown in FIGS. 2 and 3, is swung by an anvil swinging shaft 37 swung as being made to abut on surfaces of the eccentric cams 23*c* and 24*c* in the driver unit 20 and by virtually elbowed activating levers 27*a* and 27*b* made to abut on the anvil swinging shaft 37. The activating levers 27*a* and 27*b* are supported at the anvil arms 32*a* and 32*b* by second swinging fulcrums 38*a* and 38*b* and has ends thereof urged to respective edges of the anvil arms 32*a* and 32*b* by second spring 39*a* and 39*b* with engaging projects 28*a* and 28*b* made contact. For that reason, the swinging of the anvil swinging shaft 37 made by rotations of the eccentric cams 23*c* and 24*c* are directly transmitted to the activating levers 27*a* and 27*b*. At the same time, the anvil arms 32*a* and 32*b* are moved up and down with centers of the first swinging fulcrums 35*a* and 35*b* to support the sheet bundle by clamping it between the anvil 31 and a sheet table. When the anvil swinging shaft 37 is made to continue swinging by rotations of the eccentric cams 23*c* and 24*c*, this prevents the anvil arms 32*a* and 32*b* clamping the sheet bundle from rotating. When the eccentric cams 23*c* and 24*c* continue rotation further, only the activating levers 27*a* and 27*b* supported at the anvil arms 32*a* and 32*b* by the second swinging fulcrums 38*a* and 38*b* resist against the second springs 39*a* and 39*b* to swing counterclockwise without change. The anvil 31 therefore can support the sheet bundle by clamping it irrespective of thickness of the sheet bundle. In this way, reactive force of the stretched second springs 39*a* and 39*b* act on the anvil arms 32*a* and 32*b* through the activating levers 27*a* and 27*b*. This allows the anvil 31 held on the anvil arms 32*a* and 32*b* to support the sheet bundle with a certain force irrespective of the sheet bundle.

The cover 34 of the anvil 31 has the clincher unit 50 disposed therein. The clincher unit 50 is an arrangement for bending edges of the staples passed through the sheet bundle by the driver head 63 inside the driver 60. The clincher unit 50, as shown in FIG. 8, is made up of paired clinchers 51*a* and 51*b* for guiding to open and close the both edges of the staples, a clinch plate 52 for pressing at centers of clinchers 51*a* and 51*b* to bend the both edges of the staples, and a U-shaped clinch arm 53 supported swingably at the first swinging fulcrums 35*a* and 35*b* of the anvil arms 32*a* and 32*b*. The clinch arm 53 is rotatably supported at the first swinging fulcrums 35*a* and 35*b* on the apparatus frame 11 together with the anvil arms 32*a* and 32*b*. After the anvil arms 32*a* and 32*b* support the sheet bundle by clamping it, the clinch arm 53 is independently swung with centers of the first swinging fulcrums 35*a* and 35*b* by joint levers 26*a* and 26*b* interlocked with the clinch swinging pins 23*d* and 24*d*. The clinch arm 53 then moves the clinch plate 52 interlocked with the clinch arm 53. The joint levers 26*a* and 26*b*, as shown in FIG. 2, are rotatably supported at the respective swinging fulcrums of the anvil arms 32*a* and 32*b* and the clinch arm 53. The joint levers serve to transmit swinging of the first cam member 23 and the second cam member 24 in the driver unit 20 to the anvil unit 30 and the clinch unit 50.

FIG. 9 shows a staple feeding arrangement 70 for sequentially feeding the band-shaped staples 43 held in the staple supply unit 40 toward the driver 60 and the clincher unit 50. The staple feeding arrangement 70 has a staple feeding lever 71 supported swingably on the apparatus frame 11 via the staple swinging shaft 73, a staple feeding pawl 72 disposed at an end of the staple feeding lever 71, and a plate spring 74 for urging the staple feeding lever 71 to a predetermined position. Feeding the band-shaped staple 43 is made by rotating the drive gears 23*a* and 24*a* with the drive motor 21. The rotation allows staple feeding pings 23*h* and 24*h* mounted to stand at the drive gears 23*a* and 24*a* pushes rightward the staple feeding lever 71 supported to resist against the plate spring 74. This hooks the staple feeding pawl 72 on the staples 43. When the drive gears 23*a* and 24*a* are rotated, further, the staple feeding pins 23*h* and 24*h* are taken out of the staple feeding lever 71, which is then pushed back leftward by the force of the plate spring 74. In such an operation, the staples 43 are fed out toward a bending block 75 by the staple feeding pawl 72.

The staples 43 moved forward sequentially by the staple feeding arrangement 70, as shown in FIG. 10, are abutted against a staple catching groove of the square bending block 75 disposed at a front of the apparatus frame 11. A staple forming member 77 placed through a homer pin 76 at a long hole 65 of the driver head 63, then can form the staple 43 to U-shape as the driver head 63 moves up. After that, the both side plate springs 66*a* and 66*b* on the driver head 63 are moved on guide blocks 78*a* and 78*b*. This disengages the plate springs 66*a* and 66*b* from the staple forming member 77. Only the driver head 63 pushes up the U-shaped staple 43 onto the anvil 31 positioned further upward to pass it through the sheet bundle. The clincher unit 50 bends the both legs of the staple 43, completing the stapling operation.

FIG. 11 shows the sequential stapling operation of the stapler apparatus 10 as looked to the front thereof. The following describes operation steps in the order shown in the figure.

a. Initial State

This shows a state right before start of the stapling operation. The staple 43 is fed under the bending block 75 by the means described by reference to FIGS. 9 and 10. The sheet bundle 79 is aligned on the sheet table 13. The driver 60 is put at a home position at the bottom, while the anvil 31 is open as separated away from the sheet bundle 79.

b. Sheet Bundle Clamping State

When a stapling start signal is received in the state a above, the paired rotating cams 23*e* and 24*e* start rotation in arrow directions. With the rotations of the rotating cams 23*e* and 24*e*, the driver swinging pins 23*g* and 24*g* push the driver 60 upward, while the anvil 31 moves down to clamp the sheet bundle 79 in the sheet table 13.

c. Staple Forming State

The staple forming member 77 bends upward the both ends of the staple 43 put on the bending block 75 as interlocked with upward movement of the driver 60 in step b above.

d. Stapling Start State

The driver 60 and the staple forming member 77 are disengaged from the state at step c above. Only the driver 60 moves up. The end 64 on the driver head 63 then is butted against the U-shaped staple 43. The staple 43 is at the state right before being driven into the sheet bundle 79.

e. Stapling Setup State

When the driver 60 moves up further from the state at step d above, the both ends on the U-shaped staple 43 are passed through the sheet bundle 79 and run into the clinchers 51*a* and 51*b*, allowing clinching to start.

f. Clinching State

Finally, the clinching plate 52 is pushed down to bend the both ends of the staple inward. This ends the sequence of stapling operations.

The operations at steps a to f can be completed in a single turn of the driver swinging pins 23*g* and 24*g* on the rotating cams 23*e* and 24*e*. As described so far, the stapler apparatus 10 according to the present invention is excellently stable as the drive parts are driven by the two systems of cam members 23 and 24 of identical members. In particular, the rotating cams 23*e* and 24*e* and the driver swinging pins 23*g* and 24*g* for driving the driver 60 can perform smooth driving because they are symmetrical in shape and position.

FIG. 12 is a timing chart illustrating the sequential operations of the stapler apparatus. The sequential operations are described below by reference to FIGS. 12, 2, and 3 through 6. The drive motor 21 starts rotation as receiving the stapling start signal from an apparatus body (not shown). The drive motor 21, as shown in FIG. 4, transmits rotational torque through the deceleration gears 22 to the first cam member 23 and the second cam member 24. The first cam member 23 and the second cam member 24 start swinging of the anvil unit 30 first, which is large in amount of swinging. The sheets are clamped in a range of an amount of swing for two sheets (85 degrees of the sixth deceleration gear 22*f*) to an amount of swing for 50 sheets shown by dotted line in the figure. In the start, the swinging of the anvil swinging shaft 37 butted against the eccentric cams 23*c* and 24*c* is absorbed by the second springs 39*a* and 39*b* as the anvil unit 30 clamps the sheet bundle not to swing further. The driver 60 driven by the rotating cams 23*e* and 24*e* is moved a little later after swinging of the anvil unit 30. The staple forming member 77 interlocked with the driver 60 forms the staples 43 to U-shape before the driver head 63 drives the U-shaped staple 43 in position on the sheet bundle. After driving, the clincher unit 50 is returned up first by spring force together with release of the cam members. Then the anvil unit 30 also is returned up by spring force together with release of the cam members. At the same time, also, the driver unit 20 is returned down with release of the cam members, being reset to the home position.

FIG. 13 shows a second embodiment of the rotating cams. The rotating cams are made up of shafts 23*b* and 24*b* that are centers of the paired rotating cams 23*e* and 24*e* described above, the driver swinging pins 23*g* and 24*g* for swinging the driver 60, and link members 81 and 82 for linking the both cams. The driver swinging pins 23*g* and 24*g*, as shown in the figure, are deviated in phase to allow the shafts 23*b* and 24*b* to be arranged closer. It is needed that the both link members 81 and 82 should be disposed different in position not to collide into each other. The first cam member 23 and the second cam member 24 extended from the drive motor 21 should not lap over each other. The eccentric cams 23*c* and 24*c* and related parts should be miniaturized not to contact each other. The second embodiment is advantageous to reduce space of the driver unit 20, making the overall stapler apparatus compact.

FIG. 14 shows a third embodiment of the rotating cam. The rotating cams are made up of rotating cams 83 and 84 having grooves 85 and 86 formed for engaging on peripheries thereof with rotation centers of the paired shafts 23*b* and 24*b* and of the driver swinging pins 23*g* and 24*g* for swinging the driver 60. The rotating cams 83 and 84, as shown in the figure, are arranged with the shafts 23*b* and 24*b* so that the both grooves 85 and 86 can engage with each other. This allows easy synchronous rotations of the cams. The third embodiment needs just one system of serial cam members including the drive gear, eccentric cam, and rotating cam interlocked with the drive motor 21 and deceleration gears as in previous apparatuses. The swinging shaft can be given to either of the rotating cams to drive the anvil unit and clincher unit and to drive the driver securely and stably with the paired rotating cams as well as described in the first embodiment. Therefore, fewer members are needed, reducing cost of the overall stapler apparatusws.

The embodiments described so far have the anvil unit 30 swung to clamp the sheet bundle between it and the driver unit 20 placed in position. Alternatively, of course, the driver unit 20 can be swung, and both the driver unit 20 and the anvil unit 30 can be swung one another.

SYMBOLS

Figure 1:
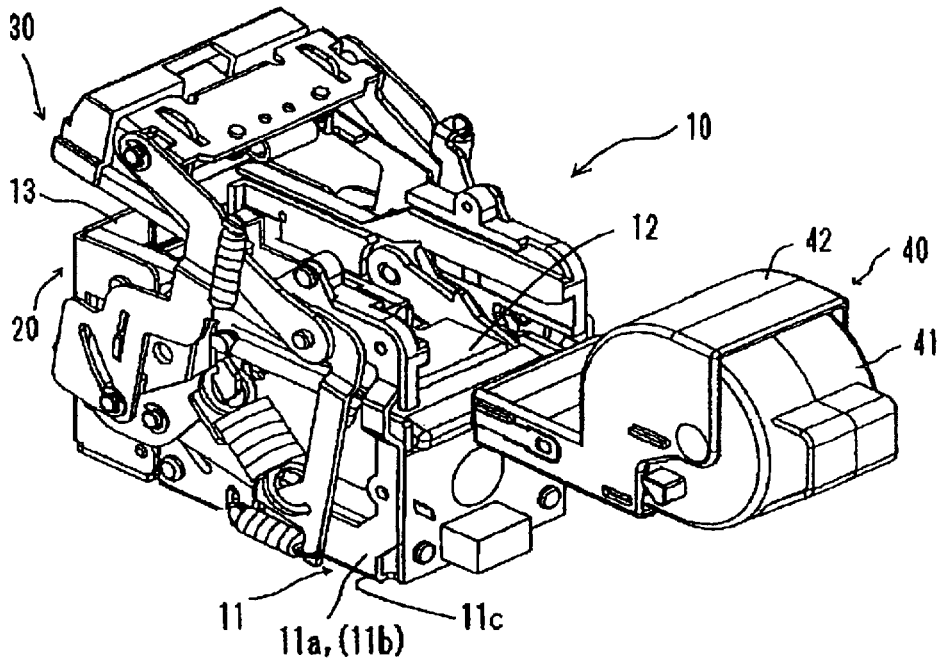
FIG. 1 is a perspective view of an overall structure of a stapler apparatus of the present invention.
Figure 2:
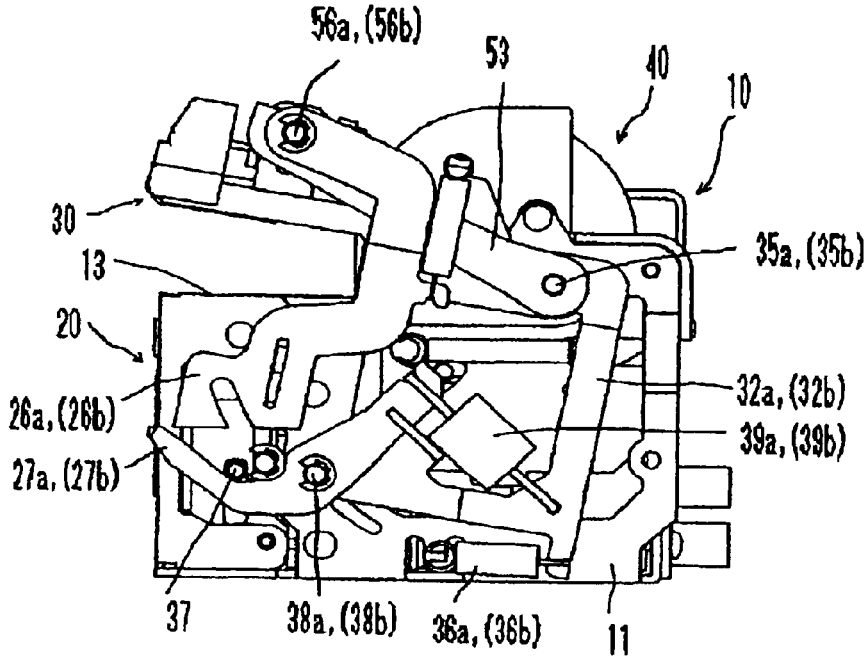
FIG. 2 is a side view of the stapler apparatus shown in FIG. 1.
Figure 3:
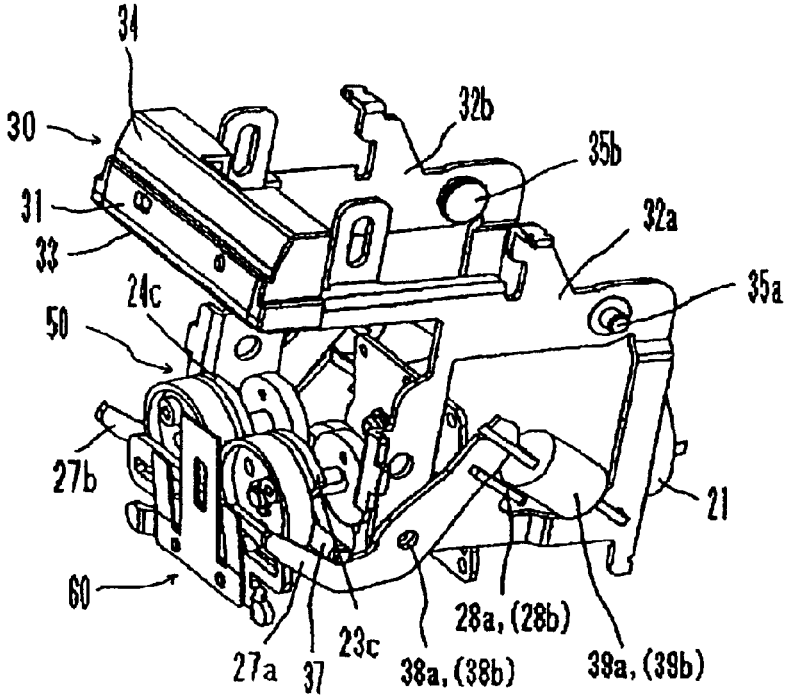
FIG. 3 is a perspective view of main units of the stapler apparatus, including a driver unit and an anvil unit.
Figure 4:
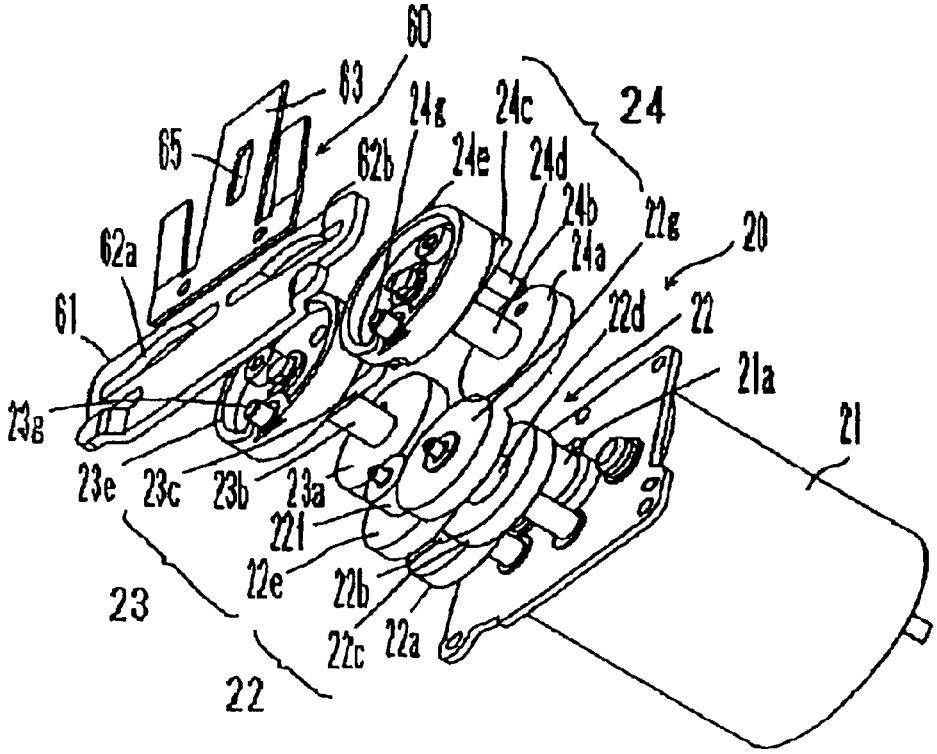
FIG. 4 is a perspective view of main parts of the driver unit.
Figure 5:
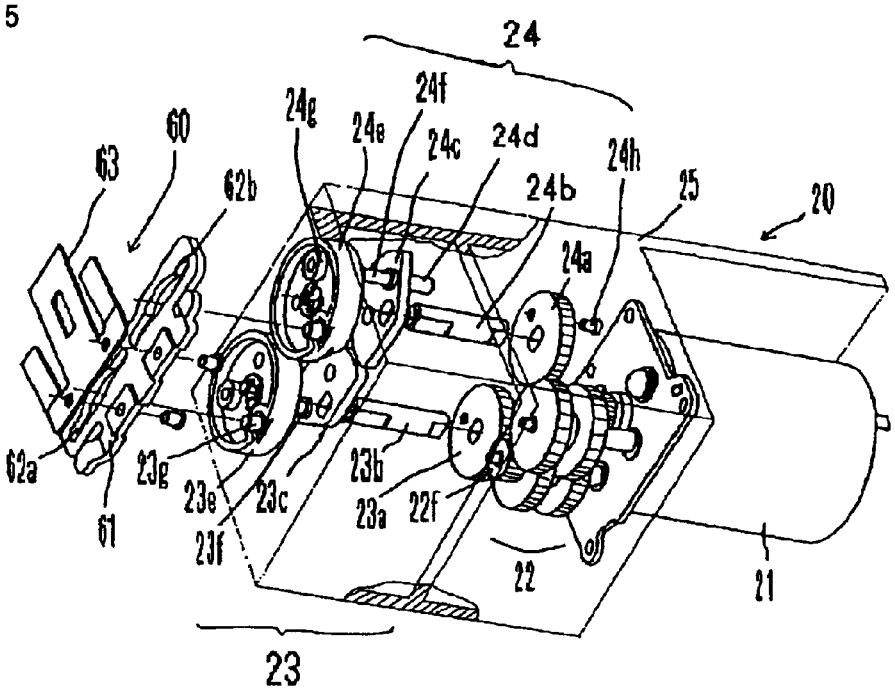
FIG. 5 is a perspective exploded view of the driver unit.
Figure 6:
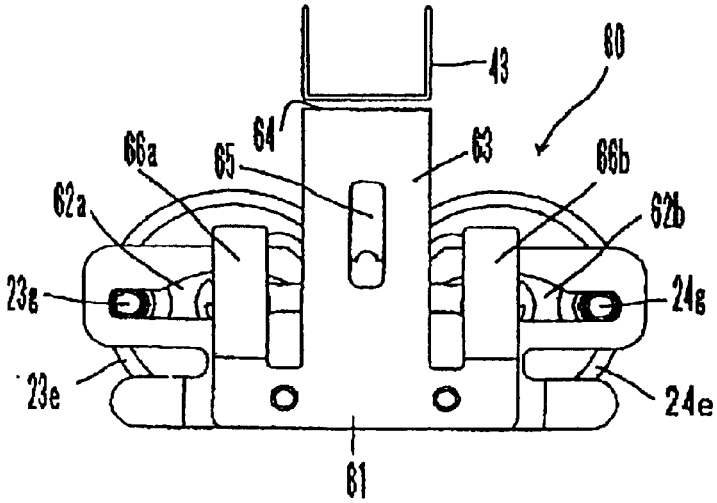
FIG. 6 is a plan view of a driver.
Figure 7:
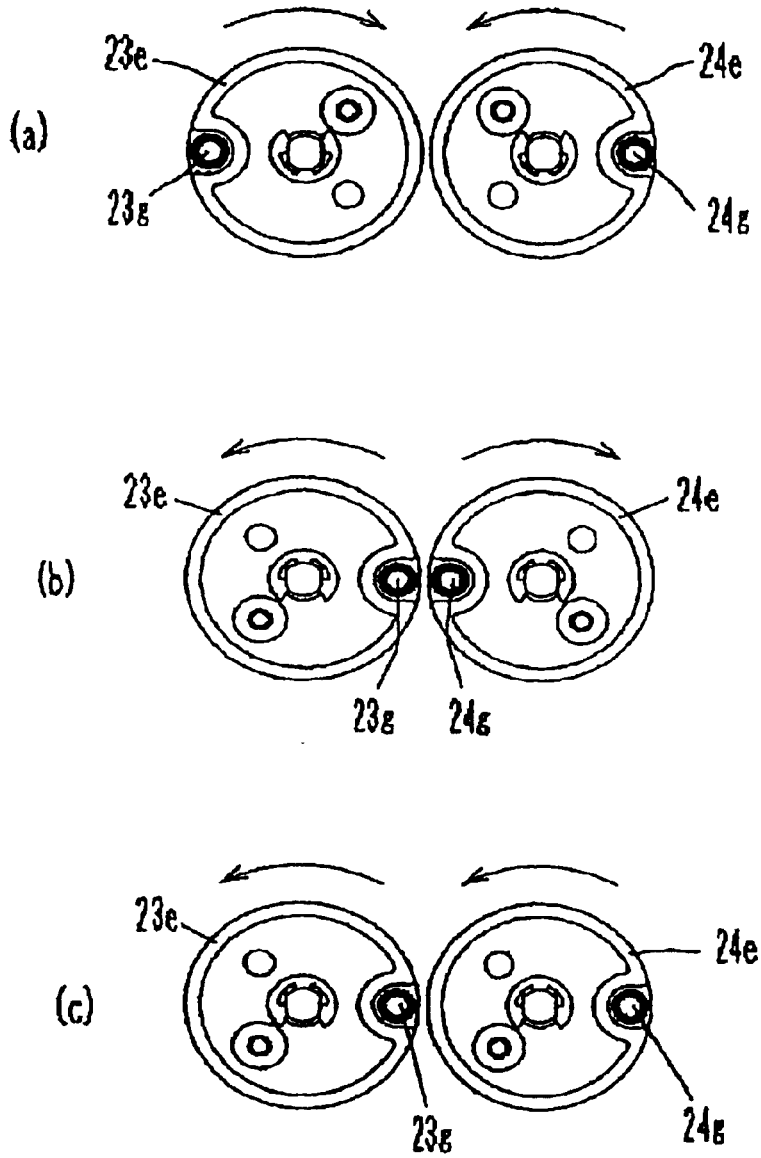
FIG. 7 is an illustration showing revolving directions of rotating cams.
Figure 8:
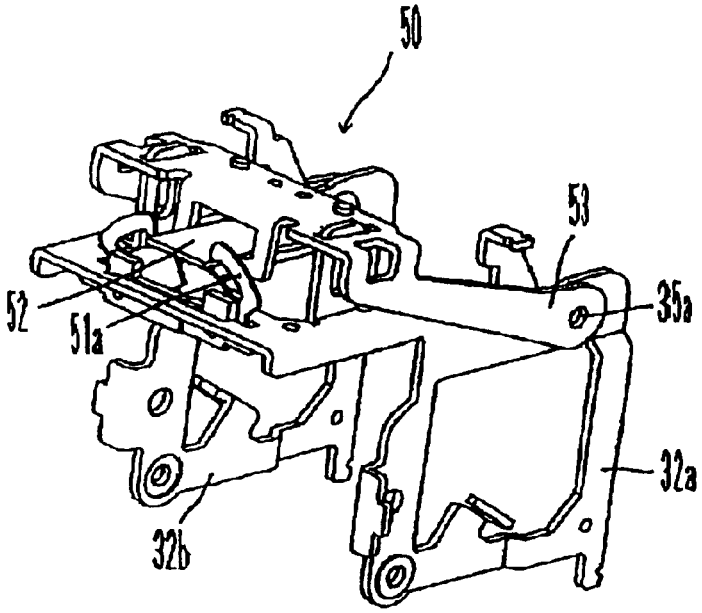
FIG. 8 is a perspective view of main parts of a clincher unit.
Figure 9:
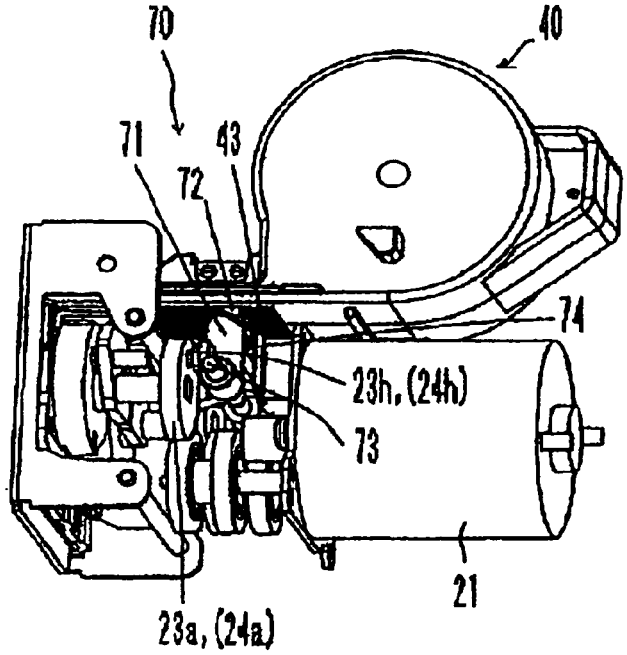
FIG. 9 is a perspective view of main parts of a staple feeding arrangement.
Figure 10:
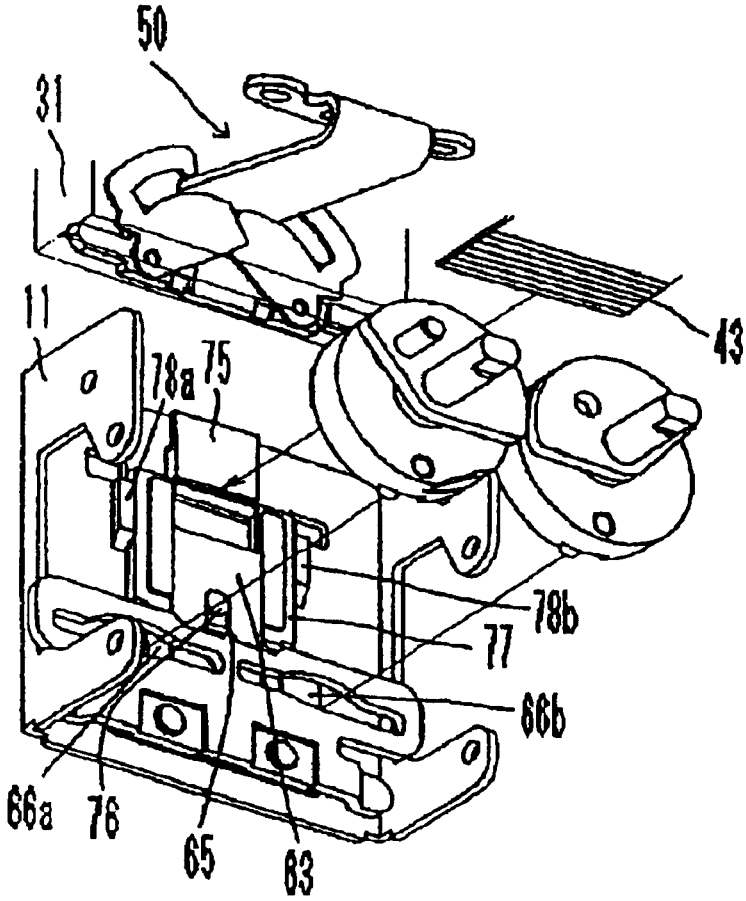
FIG. 10 is an illustration showing a forming structure of staples.
Figure 11:
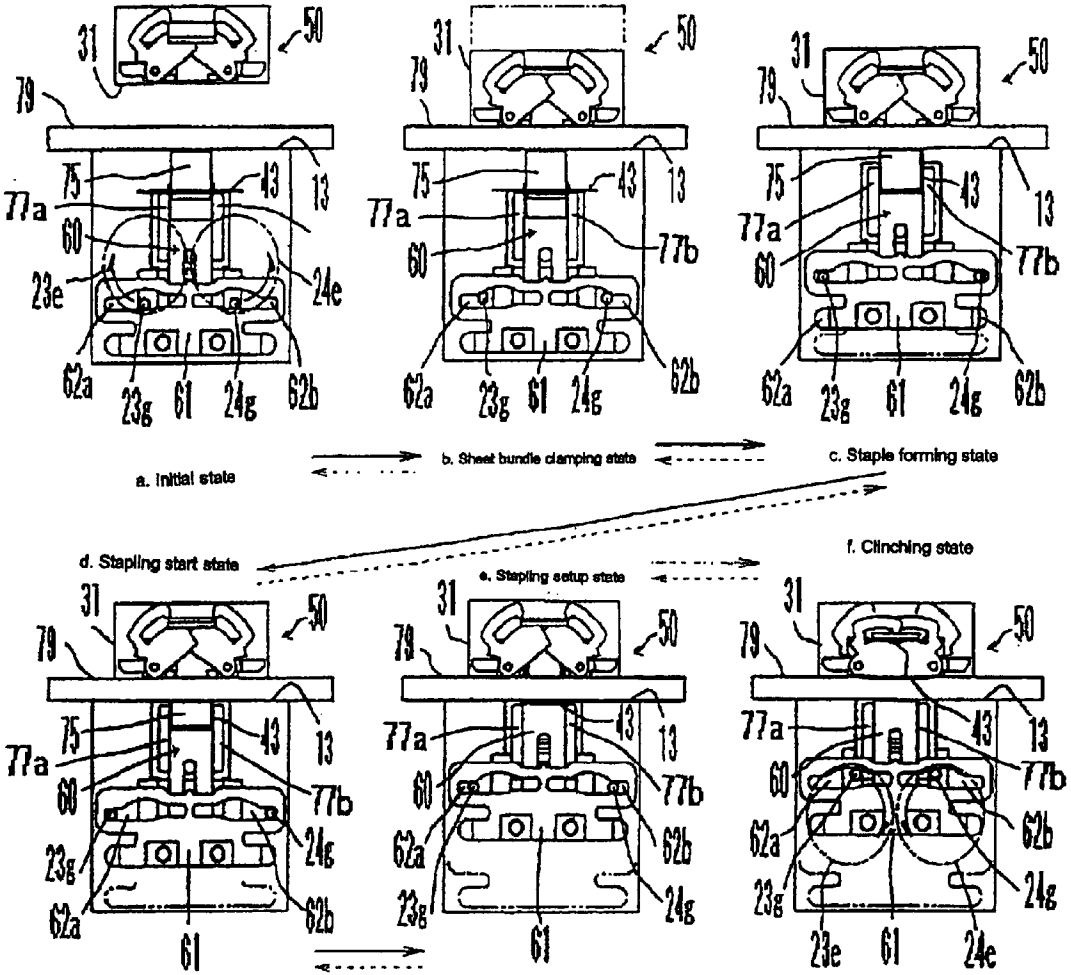
FIG. 11 is an illustration showing a sequential operation of the staples.
Figure 12:
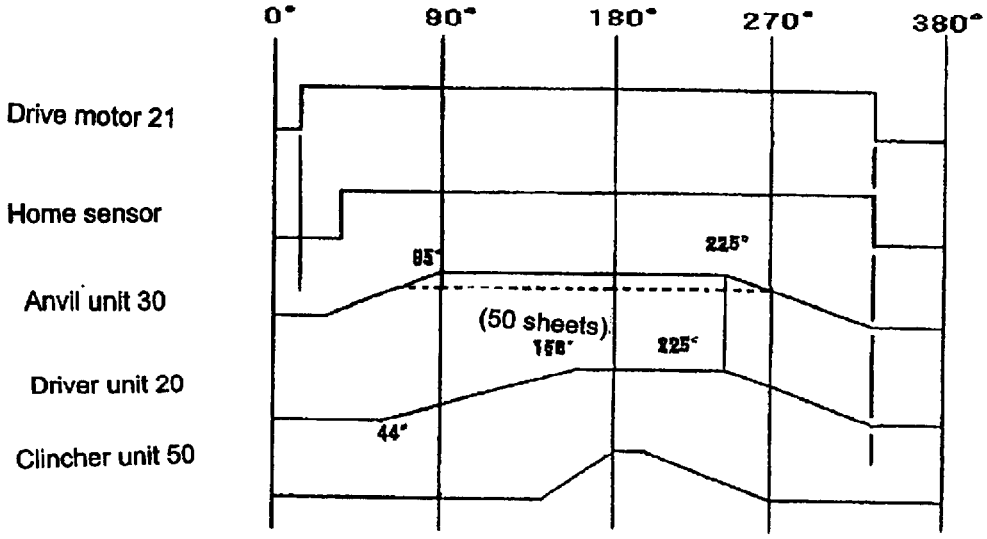
FIG. 12 is a timing chart showing the sequential operation of the staples in FIG. 11 above.
Figure 13:
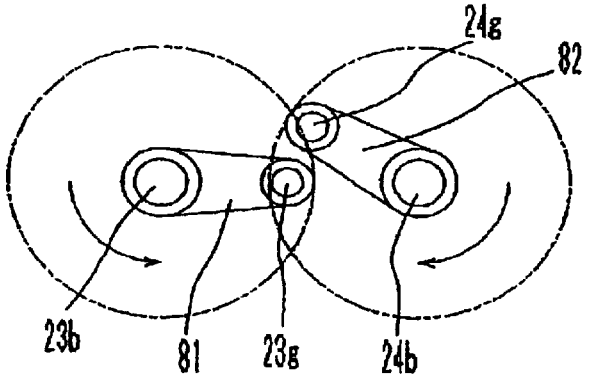
FIG. 13 is an illustration of the paired rotating cams in a second embodiment.
Figure 14:
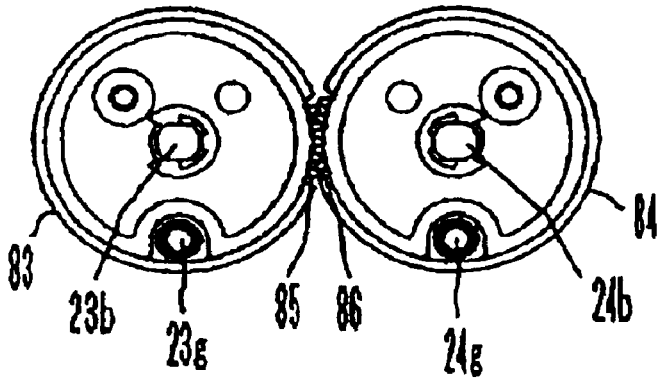
FIG. 14 is an illustration of the paired rotating cams in a third embodiment.

10=Stapler apparatus
20=Driver unit
21=Drive motor
22=Deceleration gears
23=First cam member
23*e*=Rotating cam
23*g*=Driver swinging pin
24=Second cam member
24*e*=Rotating cam
24*g*=Driver swinging pin
30=Anvil unit
40=Staple supply unit
50=Clincher unit
60=Driver
70=Staple feeding arrangement

What is claimed is:

1. A stapler apparatus comprising a staple driving member to drive staples into a sheet bundle and being reciprocally supported on a frame, the staple driving member configured to engage and drive staples, a cam member interlocked to said staple driving member to reciprocally move said staple driving member and a drive motor interlocked to said cam member, said cam member comprising:

at least two rotating cams comprising rotating shafts extending in a direction intersecting a plane formed by said staple driving member reciprocal movement locus, said two rotating cams and said staple driving member abutting at at least two points.

2. Said stapler according to claim 1, wherein said rotating shafts of said rotating cams are arranged to virtually cross said plane formed of said reciprocal movement locus of said staple driving member.

3. Said stapler apparatus according to claim 1, wherein said rotating cams have cam faces displaced in a direction of reciprocal movement of said staple driving member as said rotating cams rotate.

4. Said stapler apparatus according to claim 1, wherein at least said two rotating arms are linked to said drive motor so that said rotating cams rotate in different directions.

5. Said stapler apparatus according to claim 1, wherein said staple driving member is engaged with at least said two rotating cams to transmit forward and backward movements to said staple driving member.

6. Said stapler apparatus according to claim 5, wherein said staple driving member and said rotating cams have pin members formed on either one and slit grooves formed on said other one, said pin members and slit grooves being fitted together to engage.

7. A stapler apparatus comprising a plate-shaped staple driving member to drive staples into a sheet bundle and being reciprocally supported between left and right paired side frames, the staple driving member configured to engage and drive staples, a cam member interlocked to said staple driving member to reciprocally move said staple driving member supported between said paired side frames and a drive motor interlocked to said cam member, wherein said cam member comprises at least two rotating cams each including a respective rotating shaft, the rotating shafts thereof extending in a direction intersecting a plane formed by the locus of reciprocal movement of said staple driving member, wherein said two rotating cams and said staple driving member abut at at least two points.

8. Said stapler according to claim 7, wherein said rotating shafts of said rotating cams are arranged to virtually cross said plane formed of said reciprocal movement locus of said staple driving member.

9. Said stapler apparatus according to claim 7, wherein said rotating cams have cam faces displaced in a direction of reciprocal movement of said staple driving member as said rotating cams rotate.

10. Said stapler apparatus according to claim 7, wherein at least said two rotating cams are linked to said drive motor so that said rotating cams rotate in different directions.

11. Said stapler apparatus according to claim 7, wherein said staple driving member is engaged with at least said two rotating cams to transmit forward and backward movements to said staple driving member.

12. Said stapler apparatus according to claim 11, wherein said staple driving member and said rotating cams have pin members formed on either one and slit grooves formed on said other one, said pin members and slit grooves being fitted together to engage.

* * * * *